United States Patent [19]

DeSeyn

[11] 4,326,023

[45] Apr. 20, 1982

[54] SPECTRAL SENSITIZATION OF PHOTOGRAPHIC EMULSIONS

[75] Inventor: Mary K. DeSeyn, Rochester, N.Y.

[73] Assignee: Eastman Kodak Company, Rochester, N.Y.

[21] Appl. No.: 723,418

[22] Filed: Sep. 15, 1976

[51] Int. Cl.[3] ..... G03C 1/14

[52] U.S. Cl. ..... 430/550; 430/574; 430/588

[58] Field of Search ..... 96/124, 137; 430/574, 430/588, 550

[56] References Cited

U.S. PATENT DOCUMENTS

| | | | |
|---|---|---|---|
| 3,463,640 | 8/1969 | Ficken et al. | 96/124 |
| 3,907,575 | 9/1975 | Shiba et al. | 96/124 |
| 3,922,170 | 11/1975 | Shiba et al. | 96/124 |
| 3,967,967 | 7/1976 | Hinata et al. | 96/124 |

*Primary Examiner*—J. Travis Brown
*Attorney, Agent, or Firm*—Joshua G. Levitt

[57] ABSTRACT

Photographic emulsions are sensitized to the red region of the spectrum with a combination of three sensitizing dyes. The dyes have the generic structural formulae:

I.

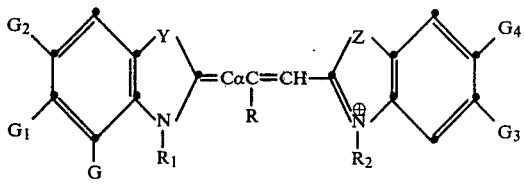

II.

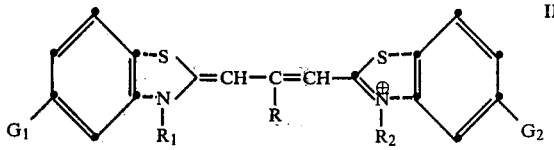

and

III.

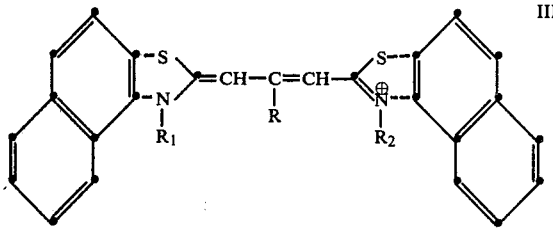

11 Claims, No Drawings

SPECTRAL SENSITIZATION OF PHOTOGRAPHIC EMULSIONS

This application relates to photographic emulsions and elements. In a particular aspect it relates to a photographic emulsion which is sensitized to the red region of the electromagnetic spectrum with a particular combination of dyes.

Schwan et al U.S. Pat. No. 3,672,898 relates to multicolor photographic elements which produce good acceptable color rendition upon exposure to any of a variety of common illuminants, such as daylight, tungsten light sources and fluorescent light sources. This is accomplished by adjusting the spectral sensitivity of the emulsions employed in the elements. One way in which this adjustment is accomplished is by employing combinations of dyes to sensitize the various emulsion layers so that sensitivities of the individual layers conform to idealized curve shapes of relative log sensitivity. Suitable dyes, and combinations thereof, for use in the red sensitive layer, are described in columns 19–21 of said U.S. Pat. No. 3,672,898.

I have found that certain combinations of dyes are particularly advantageous for sensitizing photographic emulsions to the red region of the electromagnetic spectrum. When such combinations are employed, one or more of the following advantages are obtained: (a) There is an improvement in speed compared with combinations of dyes heretofore employed. (b) There is obtained a relative log sensitivity curve having a broader peak and an improved curve shape. (c) Fewer dyes are required than previously had been employed.

The photographic emulsions of my invention are particularly advantageous as the red sensitive layer in the photographic elements described in U.S. Pat. No. 3,672,898. In addition, they are advantageously employed as the red sensitive layer in other multicolor photographic elements, or as the sole photosensitive layer in non-multicolor elements.

In accordance with my invention there is provided a photographic silver halide emulsion sensitized to the region of the electromagnetic spectrum between 590 and 640 nanometers with a dye from each of the following groups I, II and III:

I. a dye having the structural formula:

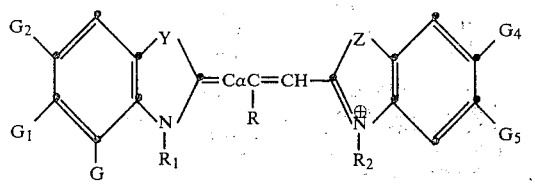

where:

Y is selenium or sulfur;

Z is oxygen or

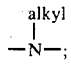

R is methyl or ethyl when Z is oxygen, and

R is hydrogen when Z is

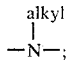

$R_1$ and $R_2$ are, independently, alkyl or acid substituted alkyl, provided at least one of $R_1$ and $R_2$ is acid substituted alkyl;

$\alpha$ is hydrogen, or $\alpha$ and $R_1$ together, are ethylene or propylene;

G is hydrogen;

$G_1$ is hydrogen, halogen or alkoxy;

$G_2$ is hydrogen or alkoxy; or

G and $G_1$ or $G_1$ and $G_2$ are the atoms necessary to complete a fused benzene ring;

$G_3$ is alkyl, alkoxy, aryl, halogen or styryl; and $G_4$ is hydrogen, alkyl or halogen;

II. a dye having the structural formula:

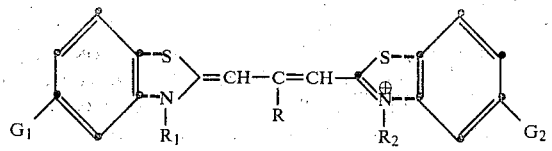

where:

R is methyl or ethyl, $R_1$ and $R_2$ are, independently, alkyl, hydroxyalkyl, or acid-substituted alkyl, provided at least one of $R_1$ and $R_2$ is acid-substituted alkyl or hydroxyalkyl; and $G_1$ and $G_2$ are, independently, hydrogen, halogen, alkyl, aryl or alkoxy, provided that at least one of $G_1$ and $G_2$ is a substituent other than hydrogen; and III. a dye having the structural formula:

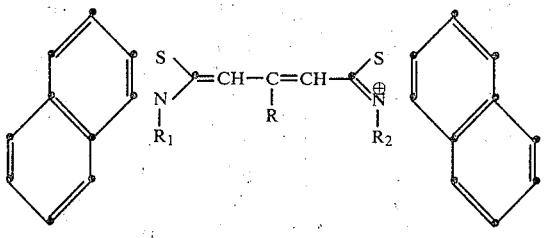

where:

R is methyl, ethyl or a negatively charged ketomethylene residue which forms an allopolarcyanine dye; and $R_1$ and $R_2$ are each, independently, alkyl or acid-substituted alkyl;

and dyes I, II, and III have associated an anion or a cation, if necessary, to neutralize the charge on the dye molecule.

As used in this specification, the following definitions apply to the substituent in the structural formulae. The alkyl and alkoxy groups typically contain 1 to 6 carbon atoms and preferably are straight chain alkyl and alkoxy groups of 1 to 4 carbon atoms. Particularly preferred alkyl and alkoxy groups are methyl, ethyl, methoxy, and ethoxy. The hydroxyalkyl groups typically contain 1 to 6 carbon atoms and preferably are hydroxypropyl and hydroxybutyl. The acid-substituted alkyl groups typically contain 1 to 6 carbon atoms and preferably are acid-substituted ethyl, propyl and butyl. Representative acid substituents include carboxy, sulfo, sulfoalkoxy, sulfato, thiosulfato, and phosphono. Particularly preferred acid-substituted alkyl groups are carboxyalkyl of 2 to 4 carbon atoms and sulfoalkyl of 2 to 4 carbon atoms. The aryl groups typically contain 6 to 10 carbon atoms. Preferred aryl are phenyl, and substituted phenyl. The preferred halogen is chlorine. Ketomethylene residues which form allopolarcyanine dyes contain the moiety $$-\overset{\overset{\displaystyle O}{\|}}{C}-CH_2-.$$

Preferred ketomethylene compounds include 1,3-chromandione (4-hydroxycoumarin), 3H-naphtho[2,1-b]pyran-1,3-(2H)-dione, 2-pyrazolin-5-one, 2-isoxazolin-5-one and indan-1,3-dione.

In a preferred embodiment of my invention the dyes have the structural formulae I, II, and III shown above wherein: in formula I, Y is sulfur, Z is oxygen, R is ethyl, $R_1$ and $R_2$ are alkyl or sulfoalkyl, provided that at least one of $R_1$ and $R_2$ is sulfoalkyl, is hydrogen, G is hydrogen, $G_1$ and $G_2$ are hydrogen or alkoxy, $G_3$ is alkyl or aryl and $G_4$ is hydrogen; in formula II, R is methyl or ethyl, $R_1$ and $R_2$ are alkyl, hydroxyalkyl or sulfoalkyl, provided at least one of $R_1$ and $R_2$ is hydroxyalkyl or sulfoalkyl and $G_1$ and $G_2$ are alkoxy; and in formula III, R is methyl or ethyl and $R_1$ and $R_2$ are sulfoalkyl.

Particularly preferred are dyes having the above structural formulae I, II, and III wherein: in formula I Y is sulfur, Z is oxygen, R is ethyl, $R_1$ and $R_2$ are sulfoalkyl, $\alpha$ is hydrogen, G is hydrogen, $G_1$ and $G_2$ are alkoxy, $G_3$ is phenyl and $G_4$ is hydrogen; in formula II, R is ethyl, $R_1$ and $R_2$ are hydroxyalkyl and $G_1$ and $G_2$ are alkoxy; and in formula III, R is ethyl and $R_1$ and $R_2$ are sulfoalkyl.

In Tables I, II, and III which follow, representative dyes having structural formulae I, II, and III, respectively, are described. In these tables, the following abbreviations are employed: 3-SB for 3-sulfobutyl, 4-SB for 4-sulfobutyl, 3-SP for 3-sulfopropyl, 3-HOPr for 3-hydroxypropyl, 2-HO Et for 2-hydroxyethyl, 2-C Et for 2-carboxyethyl and 3-C Pr for 3-carboxypropyl. Other abbreviations employ standard chemical symbols. Many of these dyes are zwitterionic compounds and hence do not have ions associated with them. Some are anionic and have associated cations, while others are cationic and have associated anions. The ions are indicated where they are associated with the dye and are necessary to neutralize the charge on the dye molecule.

TABLE I

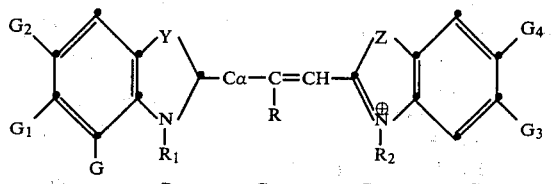

| Y | Z | R | $R_1$ | α | $R_2$ | G | $G_1$ | $G_2$ | $G_3$ | $G_4$ | Ions |
|---|---|---|---|---|---|---|---|---|---|---|---|
| 1. Se | O | $C_2H_5$ | 3-SB⊖ | H | $CH_3$ | H | H | H | $C_6H_5$ | H | — |
| 2. Se | O | $C_2H_5$ | 3-SP⊖ | H | 3-SP⊖ | H | H | H | $C_6H_5$ | H | $Na^{\oplus}$ |
| 3. Se | O | $C_2H_5$ | $C_2H_5$ | H | 3-SP⊖ | H | H | H | Cl | H | — |
| 4. Se | O | $C_2H_5$ | $C_2H_5$ | H | 3-SP⊖ | H | Cl | H | Cl | H | — |
| 5. Se | O | $C_2H_5$ | 3-SP⊖ | H | 3-SP⊖ | H | Cl | H | Cl | H | $(C_2H_5)_3N^{\oplus}$ |
| 6. Se | O | $C_2H_5$ | $C_2H_5$ | H | 3-SP⊖ | H | Cl | H | $OCH_3$ | H | — |
| 7. Se | O | $C_2H_5$ | $C_2H_5$ | H | 3-SB⊖ | H | Cl | H | $C_6H_5$ | H | — |
| 8. Se | O | $C_2H_5$ | $C_2H_5$ | H | 3-SP⊖ | H | $OCH_3$ | H | Cl | H | — |
| 9. Se | O | $C_2H_5$ | $C_2H_5$ | H | 3-SB⊖ | H | $OCH_3$ | H | $C_6H_5$ | H | — |
| 10. Se | O | $C_2H_5$ | 3-SP⊖ | H | 3-SP⊖ | H | $OCH_3$ | H | $C_6H_5$ | H | $Na^{\oplus}$ |
| 11. Se | O | $C_2H_5$ | $C_2H_5$ | H | 3-SP⊖ | H | $OCH_3$ | H | Styryl | H | — |
| 12. Se | O | $C_2H_5$ | $C_2H_5$ | H | 3-SP⊖ | H | $CH_3$ | H | Cl | H | — |
| 13. Se | O | $C_2H_5$ | $C_2H_5$ | H | 3-SB⊖ | H | $CH_3$ | H | $C_6H_5$ | H | — |
| 14. S | O | $C_2H_5$ | $C_2H_5$ | H | 3-SP⊖ | H | $OCH_3$ | H | Styryl | H | — |
| 15. S | O | $C_2H_5$ | $CH_3$ | H | 3-SP⊖ | H | $OCH_3$ | H | $CH_3$ | $CH_3$ | — |
| 16. S | O | $C_2H_5$ | $C_2H_5$ | H | 3-SP⊖ | H | $OCH_3$ | H | $CH_3$ | $CH_3$ | — |
| 17. S | O | $C_2H_5$ | $CH_3$ | H | 3-SP⊖ | H | H | $OCH_3$ | $CH_3$ | $CH_3$ | — |
| 18. S | O | $C_2H_5$ | $C_2H_5$ | H | 3-SP⊖ | H | H | $OCH_3$ | $CH_3$ | $CH_3$ | — |
| 19. S | O | $C_2H_5$ | 3-SP⊖ | H | 3-SB⊖ | H | $OCH_3$ | $OCH_3$ | $C_6H_5$ | H | $Na^{\oplus}$ |
| 20. S | O | $C_2H_5$ | $C_2H_5$ | H | 3-SP⊖ | H | H | $CH_3$ | Cl | H | — |
| 21. S | O | $C_2H_5$ | $-CH_2-CH_2-$ | | 3-SB⊖ | H | H | H | $C_6H_5$ | H | — |
| 22. S | O | $C_2H_5$ | $-CH_2-CH_2-CH_2-$ | | 3-SB⊖ | H | H | H | $C_6H_5$ | H | — |
| 23. S | O | $C_2H_5$ | $C_2H_5$ | H | 3-SP⊖ | H | $-CH=CH-CH=CH-$ | | Cl | H | — |
| 24. S | O | $C_2H_5$ | $C_2H_5$ | H | 3-SB⊖ | H | $-CH=CH-CH=CH-$ | | $C_6H_5$ | H | — |
| 25. S | O | $C_2H_5$ | 3-SP⊖ | H | 3-SB⊖ | H | $-CH=CH-CH=CH-$ | | $C_6H_5$ | H | $Na^{\oplus}$ |
| 26. S | O | $C_2H_5$ | $CH_3$ | H | 3-SP⊖ | $-CH=CH-CH=CH-$ | | H | Cl | H | — |
| 27. S | O | $C_2H_5$ | $C_2H_5$ | H | 3-SP⊖ | $-CH=CH-CH=CH-$ | | H | Cl | H | — |
| 28. S | O | $C_2H_5$ | $CH_3$ | H | 3-SP⊖ | $-CH=CH-CH=CH-$ | | H | $OCH_3$ | H | — |
| 29. S | O | $C_2H_5$ | $C_2H_5$ | H | 3-SP⊖ | $-CH=CH-CH=CH-$ | | H | $OCH_3$ | H | — |
| 30. S | O | $C_2H_5$ | $CH_3$ | H | 3-SB⊖ | $-CH=CH-CH=CH-$ | | H | $C_6H_5$ | H | — |
| 31. S | O | $C_2H_5$ | 3-SP⊖ | H | $CH_3$ | $-CH=CH-CH=CH-$ | | H | $C_6H_5$ | H | — |
| 32. S | O | $C_2H_5$ | $C_2H_5$ | H | 3-SP⊖ | $-CH=CH-CH=CH-$ | | H | Styryl | H | — |
| 33. S | O | $C_2H_5$ | $C_2H_5$ | H | 3-SP⊖ | $-CH=CH-CH=CH-$ | | H | 4-$CH_3O$Styryl | H | — |
| 34. S | O | $C_2H_5$ | $CH_3$ | H | 3-SP⊖ | $-CH=CH-CH=CH-$ | | H | $CH_3$ | $CH_3$ | — |
| 35. S | O | $C_2H_5$ | $C_2H_5$ | H | 3-SP⊖ | $-CH=CH-CH=CH-$ | | H | $CH_3$ | $CH_3$ | — |
| 36. Se | $N-C_2H_5$ | H | 3-SP⊖ | H | $C_2H_5$ | H | Cl | H | Cl | Cl | — |
| 37. Se | $N-C_2H_5$ | H | 3-SP⊖ | H | 3-SP⊖ | H | Cl | H | Cl | Cl | $(C_2H_5)_3\overset{\oplus}{N}$ |
| 38. Se | $N-C_2H_5$ | H | 3-SP⊖ | H | $C_2H_5$ | H | $OCH_3$ | H | Cl | Cl | — |
| 39. Se | $N-C_2H_5$ | H | 3-SP⊖ | H | $C_2H_5$ | H | $OCH_3$ | H | Cl | Br | — |

TABLE I-continued

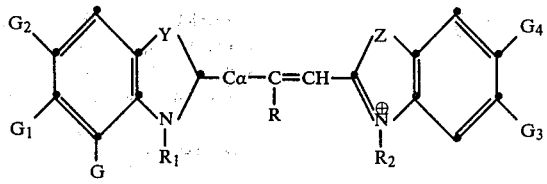

| Y | Z | R | $R_1$ | α | $R_2$ | G | $G_1$ | $G_2$ | $G_3$ | $G_4$ | Ions |
|---|---|---|---|---|---|---|---|---|---|---|---|
| 40. S | N—$C_2H_5$ | H | 3-SP⊖ | H | 3-SB⊖ | —CH=CH—CH=CH— | | H | Cl | Cl | Na⊕ |
| 41. S | N—isoC$_3$H$_7$ | H | $C_2H_5$ | H | 3-SB⊖ | —CH=CH—CH=CH— | | H | Cl | Cl | — |

TABLE II

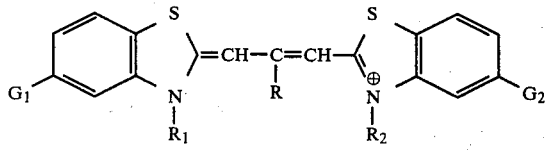

| | R | $R_1$ | $R_2$ | $G_1$ | $G_2$ | Ions |
|---|---|---|---|---|---|---|
| 1. | $CH_3$ | 3-SP⊖ | 3-SP⊖ | $OCH_3$ | $OCH_3$ | Na⊕ |
| 2. | $C_2H_5$ | $CH_3$ | 3-SP⊖ | H | $OCH_3$ | — |
| 3. | $C_2H_5$ | $CH_3$ | 4-SB⊖ | H | $C_6H_5$ | — |
| 4. | $C_2H_5$ | 3-SB⊖ | $C_2H_5$ | Cl | Cl | — |
| 5. | $C_2H_5$ | $C_4H_9$ | 3-SP⊖ | $OCH_3$ | $OCH_3$ | — |
| 6. | $CH_3$ | 3-HO Pr | 3-HO Pr | $OCH_3$ | $OCH_3$ | Br⊖ |
| 7. | $CH_3$ | 2-C Et | ⊖ 2-C Et | $CH_3$ | $CH_3$ | — |
| 8. | $CH_3$ | 4-SB⊖ | 4-SB⊖ | $OCH_3$ | $OCH_3$ | Na⊕ |

TABLE III

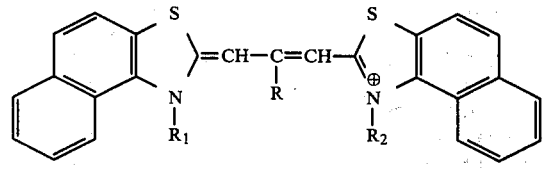

| | R | $R_1$ | $R_2$ | Ions |
|---|---|---|---|---|
| 1. | $CH_3$ | 3-SP⊖ | 3-SP⊖ | Na⊕ |
| 2. | $C_2H_5$ | 3-SP⊖ | 3-SP⊖ | $(C_2H_5)_3N$⊕ |
| 3. | * | $C_2H_5$ | $C_2H_5$ | — |

*Group derived from 1,3-Bis-(2-methoxyethyl)barbituric acid

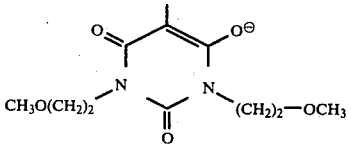

While the relative proportions of the dyes and the ratio of dye to silver halide which is employed can be varied within wide limits depending upon the particular dyes employed, the particular silver halide emulsion employed, the curve shape desired, and the like, particularly advantageous results are obtained when dye I is employed in an amount of about 0.05 to 0.5 millimoles of dye per mole of silver halide, dye II is employed in an amount of about 0.05 to 0.5 millimole of dye per mole of silver halide, and dye III is employed in an amount of about 0.01 to 0.05 millimoles of dye per mole of silver halide.

The photographic emulsions in which the dye combinations of the present invention are incorporated can comprise any suitable light sensitive silver halide emulsion, such as emulsions described in PLI Vol. 92, December 1971, Publication No. 9232, paragraph I. These emulsions can be chemically sensitized and can have typical photographic addenda incorporated therein as described in paragraphs III, IV, V, VI, VII, XI, and XII of this PLI publication. The emulsions of this invention can be employed to provide silver images or they can be employed to provide dye images, the latter typically in a multilayer, multicolor photographic element. When employed in a multilayer multicolor photographic dye image, the element can have incorporated, in association with the present emulsion, a color forming coupler, typically a cyan dye forming coupler. Suitable couplers are described in paragraph XII of the above PLI publication.

The emulsions can be employed to provide negative images or positive images. Processes for obtaining such images are well known to those skilled in the art.

The following examples are included for a further understanding of this invention.

In the following examples the controls are a four dye combination. The five controls A, B, C, D and E constitute the same four dyes but at different levels of concentration, expressed in moles of dye$\times 10^{-4}$/mole Ag. They are identified below.

| | Dye And Level Of Concentration | | | |
|---|---|---|---|---|
| Controls | I-1 | I-40 | III-2 | X |
| A | 1.21 | 1.51 | 0.171 | 0.328 |
| B | 1.21 | 1.51 | 0.153 | 0.328 |
| C | 0.870 | 1.08 | 0.153 | 0.240 |
| D | 0.870 | 1.08 | 0.116 | 0.240 |
| E | 1.21 | 0.90 | 0.153 | 0.328 |

DYE X

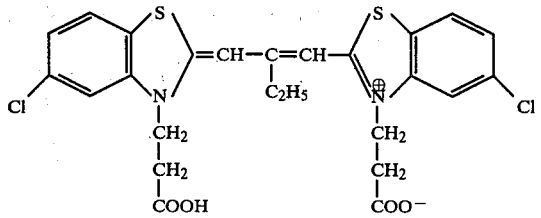

The couplers used in the following examples are:

COUPLER A

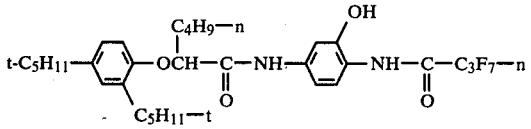

COUPLER B

-continued

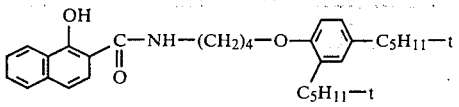

COUPLER C the visible region of the spectrum above 560 nanometers. The coatings were developed to a color positive using the process described in U.S. Pat. No. 3,046,129 column 23, line 33 through column 24, line 24. Time of first development for combinations 1–6 was 2 minutes 45 seconds and for combinations 7–10 was 75 seconds.

TABLE IV

| Combination Number | Dye I | Level | Dye II | Level | Dye III | Level | Relative Speed | Sensitivity Maximum |
|---|---|---|---|---|---|---|---|---|
| 1. | 38 | 3.0 | 3 | 3.0 | 2 | 0.171 | 126 | 610 |
| 2. | 1 | 2.5 | 3 | 3.75 | 2 | 0.171 | 126 | 600–610 |
| Control A | | | | | | | 100 | 610 |
| 3. | 9 | 2.5 | 5 | 2.5 | 2 | 0.171 | 97 | 620 |
| Control A | | | | | | | 100 | 600 |
| 4. | 36 | 3.0 | 3 | 3.0 | 2 | 0.171 | 120 | 610 |
| Control A | | | | | | | 100 | 600 |
| 5. | 36 | 3.0 | 3 | 3.0 | 2 | 0.171 | 159 | 610 |
| Control A | | | | | | | 100 | 600 |
| 6. | 41 | 4.18 | 5 | 2.625 | 2 | 0.306 | 151 | 610 |
| Control A | | | | | | | 100 | 600–608 |
| 7. | 36 | 2.0 | 2 | 1.0 | 2 | 0.153 | 182 | 600 |
| 8. | 36 | 3.0 | 2 | 2.0 | 2 | 0.153 | 174 | 610 |
| 9. | 36 | 2.5 | 2 | 2.5 | 2 | 0.153 | 174 | 600–620 |
| 10. | 36 | 3.0 | 2 | 1.5 | 2 | 0.153 | 159 | 600 |
| Control B | | | | | | | 100 | 600–610 |

Levels are expressed as moles of dye $\times 10^{-4}$/mole Ag.

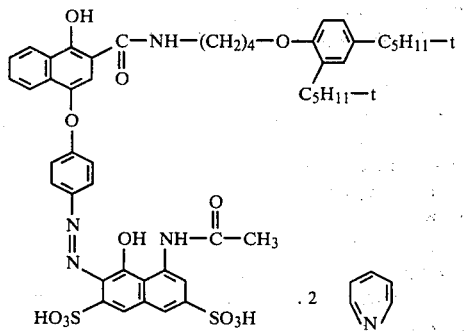

EXAMPLE 1

The dye combinations of Table IV were added to separate portions of a gelatino silver bromoiodide emulsion containing six mole percent iodide at the levels indicated in the table and equal amounts of couplers A and B, dispersed in n-butyl phthalate, were incorporated in the emulsion. The resulting mixtures were coated to obtain silver coverage of 1.6 g/m$^2$ and coupler coverage of 1.6 g/m$^2$ on a cellulose ester support. An example of each coating was exposed to a tungsten light source in an Eastman 1B Sensitometer through a wedge spectrograph and through a continuous step wedge using a Wratten 23A filter which transmits radiation in With each of the combinations of the present invention a broadening of the relative log sensitivity curve is observed compared to the control and in all but one instance an increase in relative speed is obtained.

EXAMPLE 2

The dye combinations of Table V were added to separate portions of a gelatino silver bromoiodide emulsion containing six mole percent iodide at the levels indicated in the table and couplers dispersed in tricresylphosphate were incorporated. In combinations 1–11, the couplers were B and C in a 9:1 ratio. In the remainder of the combinations, coupler B, alone, was used. The resulting mixtures were coated on a cellulose ester support to obtain silver coverages of 1.9 g/m$^2$ for combinations 1–54 and 2.2 g/m$^2$ for combinations 55–57 and coupler coverages of 0.97 g/m$^2$ for combinations 1–11, 0.86 g/m$^2$ for combinations 12–54 and 0.23 g/m$^2$ for combinations 55–57. A sample of each coating was exposed to a tungsten light source in an Eastman 1B Sensitometer through a wedge spectrograph and continuous step wedge using a Wratten 23A filter. The coatings were developed to a color negative using the process described in U.S. Pat. No. 3,046,129. Time of development was 2½ minutes for combinations 1–2, 3 minutes for combinations 3–54 and 2¾ minutes for combinations 55–57.

TABLE V

| Combination Number | Dye I | Level | Dye II | Level | Dye III | Level | Relative Speed | Sensitivity Maximum |
|---|---|---|---|---|---|---|---|---|
| 1. | 36 | 0.75 | 3 | 1.50 | 2 | 0.153 | 126 | 610 |
| Control D | | | | | | | 100 | 610 |
| 2. | 36 | 2.187 | 1 | 1.25 | 2 | 0.192 | 138 | 625 |
| Control C | | | | | | | 100 | 610–620 |
| 3. | 38 | 2.18 | 1 | 1.24 | 2 | 0.153 | 120 | 620 |
| 4. | 30 | 2.18 | 1 | 1.24 | 2 | 0.153 | 123 | 620 |
| Control B | | | | | | | 100 | 600–610 |
| 5. | 30 | 2.18 | 1 | 1.24 | 2 | 0.153 | 120 | 615 |
| 6. | 21 | 2.18 | 1 | 1.24 | 2 | 0.153 | 110 | 620 |
| 7. | 39 | 2.18 | 1 | 1.24 | 2 | 0.153 | 97 | 620 |
| Control B | | | | | | | 100 | 610 |
| 8. | 11 | 2.18 | 1 | 1.24 | 2 | 0.153 | 83 | 620 |
| 9. | 14 | 2.18 | 1 | 1.24 | 2 | 0.153 | 87 | 620 |
| 10. | 32 | 2.18 | 1 | 1.24 | 2 | 0.153 | 94 | 620 |
| 11. | 30 | 2.18 | 1 | 1.24 | 2 | 0.153 | 91 | 620 |

TABLE V-continued

| Combination Number | Dye I | Level | Dye II | Level | Dye III | Level | Relative Speed | Sensitivity Maximum |
|---|---|---|---|---|---|---|---|---|
| Control B | | | | | | | 100 | 610 |
| 12. | 40 | 2.0 | 1 | 1.0 | 2 | 0.153 | 107 | 610–620 |
| Control B | | | | | | | 100 | 600–610 |
| 13. | 33 | 2.18 | 1 | 1.24 | 2 | 0.153 | 95 | 620 |
| 14. | 30 | 2.18 | 1 | 1.24 | 2 | 0.153 | 112 | 610–620 |
| 15. | 27 | 2.18 | 1 | 1.24 | 2 | 0.153 | 107 | 620 |
| 16. | 2 | 2.18 | 1 | 1.24 | 2 | 0.153 | 89 | 620 |
| 17. | 8 | 2.18 | 1 | 1.24 | 2 | 0.153 | 97 | 620 |
| 18. | 4 | 2.18 | 1 | 1.24 | 2 | 0.153 | 105 | 620 |
| 19. | 5 | 2.18 | 1 | 1.24 | 2 | 0.153 | 129 | 620 |
| 20. | 7 | 2.18 | 1 | 1.24 | 2 | 0.153 | 115 | 610–620 |
| 21. | 40 | 2.18 | 1 | 1.24 | 2 | 0.153 | 94 | 610–620 |
| Control B | | | | | | | 100 | 590–610 |
| 22. | 20 | 2.18 | 1 | 1.24 | 2 | 0.153 | 118 | 630 |
| 23. | 22 | 2.18 | 1 | 1.24 | 2 | 0.153 | 115 | 620 |
| 24. | 21 | 2.18 | 1 | 1.24 | 2 | 0.153 | 105 | 620–630 |
| 25. | 19 | 2.18 | 1 | 1.24 | 2 | 0.153 | 102 | 620–630 |
| 26. | 30 | 2.18 | 1 | 1.24 | 2 | 0.153 | 110 | 620 |
| 27. | 37 | 2.18 | 1 | 1.24 | 2 | 0.153 | 91 | 610–620 |
| 28. | 7 | 2.18 | 1 | 1.24 | 2 | 0.153 | 112 | 620 |
| Control B | | | | | | | 100 | 600–610 |
| 29. | 30 | 1.21 | 1 | 0.691 | 2 | 0.107 | 105 | 610 |
| 30. | 19 | 1.21 | 1 | 0.691 | 2 | 0.107 | 94 | 610–630 |
| 31. | 9 | 1.21 | 1 | 0.691 | 2 | 0.107 | 107 | 610 |
| 32. | 10 | 1.21 | 1 | 0.691 | 2 | 0.107 | 102 | 610 |
| 33. | 2 | 1.21 | 1 | 0.691 | 2 | 0.107 | 105 | 610 |
| 34. | 1 | 1.21 | 1 | 0.691 | 2 | 0.107 | 95 | 610 |
| 35. | 4 | 1.21 | 1 | 0.691 | 2 | 0.107 | 141 | 610 |
| 36. | 5 | 1.21 | 1 | 0.691 | 2 | 0.107 | 141 | 610–620 |
| Control B | | | | | | | 100 | 600–610 |
| 37. | 9 | 1.21 | 1 | 0.691 | 2 | 0.153 | 145 | 610–620 |
| 38. | 7 | 1.21 | 1 | 0.691 | 2 | 0.153 | 138 | 610 |
| 39. | 4 | 1.21 | 1 | 0.691 | 2 | 0.153 | 159 | 620 |
| 40. | 5 | 1.21 | 1 | 0.691 | 2 | 0.153 | 151 | 610 |
| 41. | 3 | 1.21 | 1 | 0.691 | 2 | 0.153 | 129 | 610 |
| 42. | 2 | 1.21 | 1 | 0.691 | 2 | 0.153 | 115 | 610 |
| 43. | 15 | 1.21 | 1 | 0.691 | 2 | 0.153 | 141 | 610–620 |
| 44. | 16 | 1.21 | 1 | 0.691 | 2 | 0.153 | 135 | 610–620 |
| 45. | 17 | 1.21 | 1 | 0.691 | 2 | 0.153 | 145 | 630 |
| 46. | 18 | 1.21 | 1 | 0.691 | 2 | 0.153 | 145 | 610–620 |
| 47. | 30 | 1.21 | 1 | 0.691 | 2 | 0.153 | 132 | 610 |
| Control B | | | | | | | 100 | 590–610 |
| 48. | 28 | 1.21 | 1 | 0.691 | 2 | 0.153 | 170 | 610–620 |
| 49. | 26 | 1.21 | 1 | 0.691 | 2 | 0.153 | 195 | 610–620 |
| 50. | 30 | 1.21 | 1 | 0.691 | 2 | 0.153 | 182 | 610 |
| 51. | 35 | 1.21 | 1 | 0.601 | 2 | 0.153 | 209 | 610–630 |
| 52. | 34 | 1.21 | 1 | 0.691 | 2 | 0.153 | 195 | 620 |
| Control B | | | | | | | 100 | 610 |
| 53. | 23 | 2.18 | 1 | 1.24 | 2 | 0.153 | 129 | 620 |
| 54. | 24 | 2.18 | 1 | 1.24 | 2 | 0.153 | 107 | 610 |
| Control E | — | — | — | — | — | — | 100 | 590–610 |
| 55. | 19 | 1.8 | 6 | 1.22 | 2 | 0.153 | 138 | 620 |
| 56. | 19 | 0.69 | 4 | 1.93 | 3 | 0.153 | 105 | 640 |
| 57. | 40 | 0.69 | 4 | 1.93 | 3 | 0.080 | 97 | 640 |
| Control B | | | | | | | 100 | 610 |

Levels are expressed as moles of dye $\times 10^{-4}$/mole Ag.

With each of the combinations of the present invention a broadening of the relative log sensitivity curve is observed compared to the control and in most instances an increase in relative speed is obtained.

The invention has been described in detail with particular reference to preferred embodiments thereof, but it will be understood that variations and modifications can be effected within the spirit and scope of the invention.

What is claimed is:

1. A photographic silver halide emulsion sensitized to the region of the electromagnetic spectrum between 590 and 640 nanometers with a dye from each of the following groups I, II and III:

I. a dye having the structural formula:

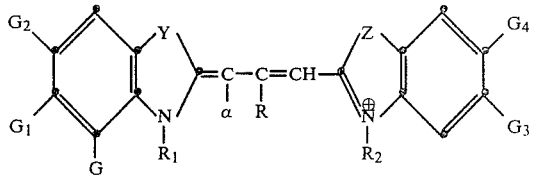

where:

Y is selenium or sulfur;

Z is oxygen or

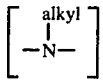

R is methyl or ethyl;

$R_1$ and $R_2$ are each acid substituted alkyl;

$\alpha$ is hydrogen;

G is hydrogen;

$G_1$ is hydrogen, halogen or alkoxy;

$G_2$ is hydrogen or alkoxy; or

G and $G_1$ or $G_1$ and $G_2$ are the atoms necessary to complete a fused benzene ring;

$G_3$ is alkyl, alkoxy, aryl, halogen or styryl; and $G_4$ is hydrogen, alkyl or halogen;

II. a dye having the structural formula:

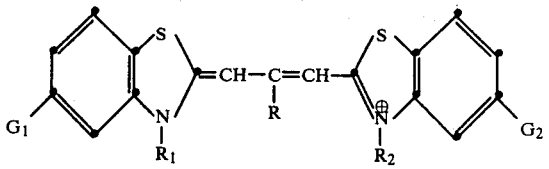

where:

R is methyl or ethyl, $R_1$ and $R_2$ are each hydroxyalkyl or each acid-substituted alkyl; and $G_1$ and $G_2$ are, independently, hydrogen, halogen, alkyl, aryl or alkoxy, provided that at least one of $G_1$ and $G_2$ is a substituent other than hydrogen; and III. a dye having the structural formula:

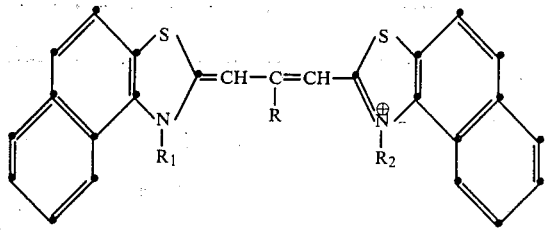

where:

R is methyl, ethyl or a negatively charged ketomethylene residue which forms an allopolarcyanine dye; and $R_1$ and $R_2$ are each acid-substituted alkyl; and dyes I, II and III have associated an anion or a cation, if necessary to neutralize the charge on the dye molecule.

2. A photographic emulsion of claim 1 wherein; in formula I, Y is sulfur, R is ethyl, $R_1$ and $R_2$ are sulfoalkyl, $\alpha$ is hydrogen, G is hydrogen, $G_1$ and $G_2$ are hydrogen or alkoxy, $G_3$ is alkyl or aryl and $G_4$ is hydrogen; in formula II, R is methyl or ethyl, $R_1$ and $R_2$ are each hydroxyalkyl or each sulfoalkyl and $G_1$ and $G_2$ are alkoxy; and in formula III, R is methyl or ethyl and $R_1$ and $R_2$ are sulfoalkyl.

3. A photographic emulsion of claim 1, wherein: in formula I, Y is sulfur, R is ethyl, $R_1$ and $R_2$ are sulfoalkyl, $\alpha$ is hydrogen, G is hydrogen, $G_1$ and $G_2$ are alkoxy, $G_3$ is phenyl and $G_4$ is hydrogen; in formula II, R is ethyl, $R_1$ and $R_2$ are hydroxyalkyl and $G_1$ and $G_2$ are alkoxy; and in formula III, R is ethyl and $R_1$ and $R_2$ are sulfoalkyl.

4. A photographic emulsion of claim 1, wherein the dyes of formulae I and II are present in an amount of about 0.05 to 0.5 millimole of dye per mole of silver halide and the dye of formula III is present in an amount of about 0.01 to 0.05 millimole of dye per mole of silver halide.

5. A photographic element comprising a support bearing a layer of the emulsion of claim 1.

6. A photographic element comprising a support bearing a layer of the emulsion of claim 2.

7. A photographic element comprising a support bearing a layer of the emulsion of claim 3.

8. A photographic element of claim 5, wherein the emulsion layer is one of the layers in a multilayer, multicolor photographic element.

9. A photographic element of claim 7, wherein the emulsion layer is one of the layers in a multilayer, multicolor photographic element.

10. A photographic element of claim 8, wherein the emulsion layer has associated with it a color coupler.

11. A photographic element of claim 10, wherein the color coupler is a cyan dye producing color coupler.

* * * * *